United States Patent [19]

Zunft et al.

[11] 3,962,658

[45] June 8, 1976

[54] POWER POLE MODULE FOR CONTACTOR

[75] Inventors: Donald V. Zunft, Greendale; Siegfried Weidmann, Brown Deer; Dennis J. Trendel, Mukwonago, all of Wis.

[73] Assignee: Allen-Bradley Company, Milwaukee, Wis.

[22] Filed: Nov. 18, 1974

[21] Appl. No.: 524,670

[52] U.S. Cl. ..... 335/133; 335/132; 335/202

[51] Int. Cl.[2] ..... H01H 50/04; H01H 50/62

[58] Field of Search ..... 335/132, 133, 202, 296

[56] References Cited

UNITED STATES PATENTS

| | | | |
|---|---|---|---|
| 3,134,869 | 5/1964 | Lawrence | 335/296 |
| 3,339,161 | 8/1967 | Conner et al. | 335/133 |
| 3,382,469 | 5/1968 | Conner | 335/132 |
| 3,614,680 | 10/1971 | Haydu | 335/132 |

*Primary Examiner*—Harold Broome
*Attorney, Agent, or Firm*—Quarles & Brady

[57] ABSTRACT

The number of poles on an electromagnetically operated contactor is increased by mounting one or two power pole modules to its sides. Each power pole module includes a housing which encloses a set of main line contacts that are coupled to the contactor for operation by its slidably mounted actuator. Flexible fastening elements on the power pole module mate with corresponding mounting elements formed on each side of the contactor to facilitate attachment of the module. Symmetrical loading on the contactor actuator is maintained by mounting power pole modules on each side of the contactor, or by using in place of one of them, a load balancer cartridge which simulates the loading of a module.

12 Claims, 8 Drawing Figures

9
6
2
9
1
9
52
78
43
38
39
36
66
8
8
8
43
48
29
29
90
90
49
77
46
30
30
35
64
26
61
65
31
46
25
45
45
18
62
18
23
53
28
15
21
24
22
23
23
9
9
2
2

52
78
38
39
43
43
48
90
90
29
36
77
49
30
46
46
35
62
61
31
45
45
60
60
17
59
18
53

POWER POLE MODULE FOR CONTACTOR

BACKGROUND OF THE INVENTION

The field of the invention is electrical switches, and more specifically, electromagnetically operated switches such as relays and line contactors which have a slidably mounted actuator for effecting engagement and disengagement of one or more sets of contact structures.

Electromagnetic contactors such as that disclosed in U.S. Pat. No. 3,134,869 issued to L. E. Lawrence on May 26, 1964, are commonly employed in motor controls. In such motor controls, the contactor typically includes a set of three main contact structures, or power poles, which are connected to carry three-phase power to the motor. Although three-pole contactors are thus required in the vast majority of installations, it is sometimes necessary to provide additional power poles beyond the three which are normally provided on standard commercially available contactors. For example, in cold climate applications the motor control may operate both a three-phase motor and a space heater which is energized when the motor is stopped. The provision of additional power poles for such an installation has heretofore been treated as a special customer request which required extensive modification of a standard three-pole contactor.

Contactors such as that described in the above-cited U.S. Pat. No. 3,134,869, include an actuator which is slidably mounted to operate the main contacts when an electromagnet is energized. Bias springs associated with the main contacts are compressed during the sliding motion of the actuator to provide contact pressure and the loading on the actuator which results from the bias springs is symmetrically balanced with respect to the actuator axis of motion in order to minimize the frictional wear between the actuator and the guideway in which it slides. Such load balancing must be taken into consideration when additional power poles are added to the contactor.

SUMMARY OF THE INVENTION

The present invention relates to a power pole module which may be mounted alongside the contact enclosure of an electrical switch to increase the number of power poles on the switch. More specifically, the invention resides in a switch having a base, a contact enclosure connected to the base and enclosing a set of stationary contacts, an actuator mounted to the base to slide along an actuator axis and to operate a set of movable contacts between an open position and a closed position in which they engage the stationary contacts, and a power pole module mounted alongside the contact enclosure and including a set of stationary contacts and a set of movable contacts which are linked to the actuator for operation thereby.

The invention further resides in a power pole module which is mounted alongside the contactor and includes a slidably mounted plunger which carries a set of movable contacts and which couples with the contactor actuator for motion along an axis parallel to the actuator axis. A load balancer mounted alongside the contact enclosure on the side opposite the power pole module is coupled to the contactor actuator for maintaining symmetrical loading thereon.

Yet another aspect of the invention is the means used to mount the power pole module to the side of the contactor, which means includes a set of mounting elements formed on the side of the contactor and a set of corresponding fastening elements which mate with the mounting elements and which are formed on the module. At least one of the fastening elements is formed from a flexible material which provides a fastening force that holds the module firmly in place.

It is a general object of the invention to provide a compact power pole module which may be securely mounted to a contactor to increase the number of poles controlled by the contactor actuator. The power pole module is mounted alongside the contactor by resilient fastening elements which attach to the power pole module housing. A spring-fit mounting arrangement is thus provided which does not require close interface tolerances between the mating parts, but which generates a fastening force that insures secure attachment of the module to the contactor. The spring-fit mounting arrangement also provides a yieldable fastener which minimizes vibration of the module during use.

Another general object of the invention is to provide a power pole module which maintain symmetrical loading on the contactor actuator. Symmetrical loading is maintained by mounting a pair of power pole modules to the contact enclosure with one mounted to each side of the actuator axis and spaced equidistant therefrom. The loading imposed on the contactor actuator by the bias spring in each power pole module is thus balanced by the load imposed by the other power pole module. On the other hand when only one power pole module is needed, a load balancer cartridge is mounted to the contact enclosure on the side opposite the power pole module to furnish a biasing force which insures symmetrical loading on the actuator.

A more specific object of the invention is to provide a self-contained power pole module which supplies additional input and output terminals for an electromagnetic contactor. The power pole module includes all the elements of an additional load current-carrying pole and these are compactly mounted within a housing which is easily attached to the contactor.

A further specific object of the invention is to provide a power pole module and load balancer which are interchangeable and may be mounted on either side of the contactor.

Yet another specific object of the invention is to provide a power pole module in which the contacts may be readily inspected for wear. An observation window is formed in the module housing through which the contact structure may be inspected by removing an insert on the front face of the module.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is therefore made to the claims herein for interpreting the scope of the invention.

DESCRIPTION OF THE PREFERRED EMBODIMENT

Figure 1:
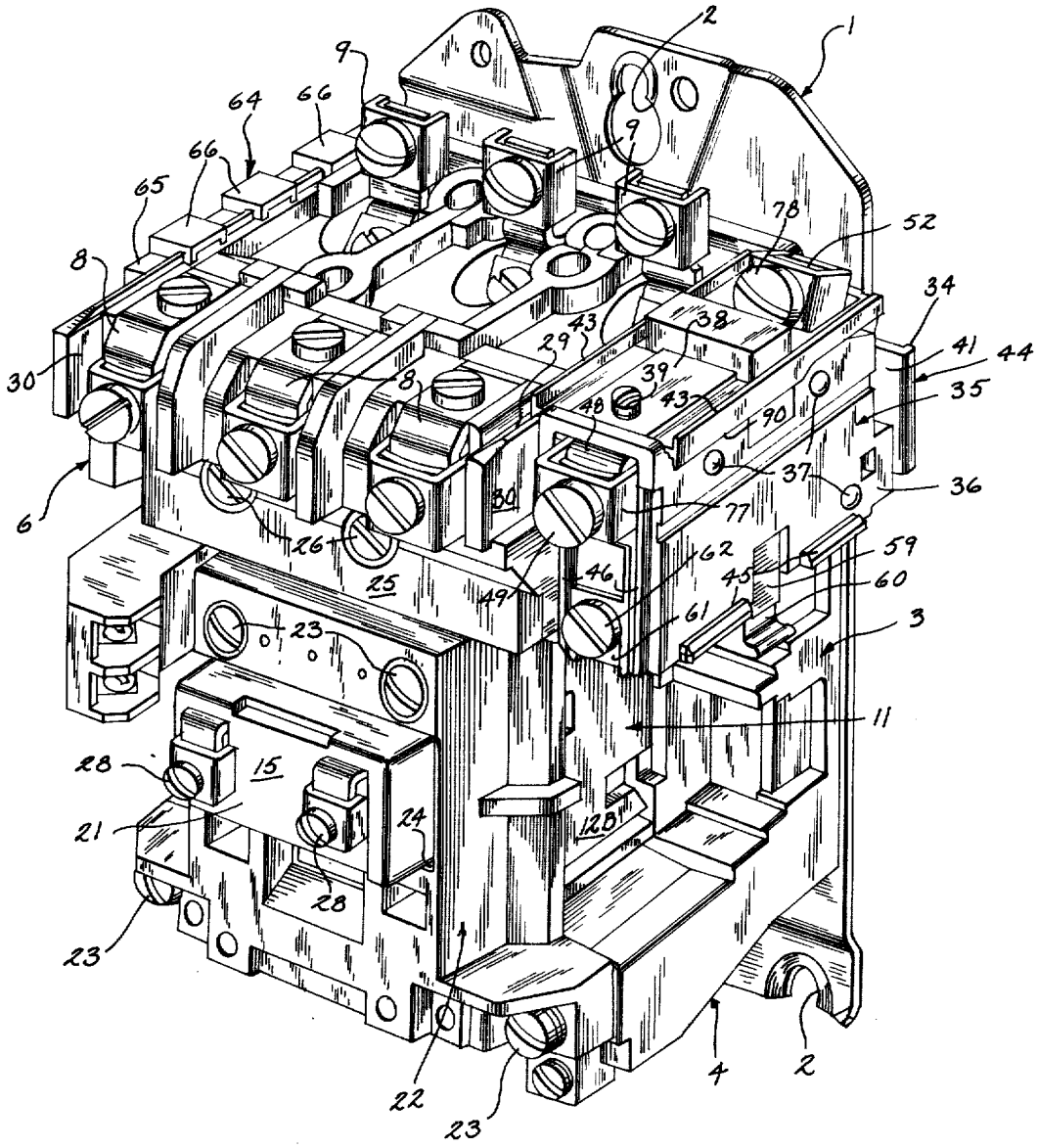
FIG. 1 is a perspective view of the contactor with an attached power pole module and load balancer cartridge.

Referring particularly to FIGS. 1–4, the contactor includes a sheet metal mounting plate 1 having a set of apertures 2 for mounting on a panel or in an enclosure. A base structure 3 molded from a thermoset polyester insulating material is fastened to the mounting plate 1 and extends forward therefrom to provide the framework for the contactor. The base 3 includes an integrally molded terminal post portion 4 which extends forward from its lower end, a pair of integrally molded support posts 5 which extend forward from its mid section, and a molded line contact enclosure 6 which extends forward from the upper end of the base 3. The contact enclosure 6 mounts three sets of stationary line contacts 7 which connect to three corresponding input terminals 8 and three sets of corresponding output terminals 9. The contacts 7 and terminals 8 and 9 form a three-phase circuit in which the conductance is controlled by the operation of the contactor.

The base 3 forms a guideway indicated generally at 10 which slidably mounts an actuator 11 for operation along a vertical actuator axis. The actuator 11 is formed from molded polyester and includes a pair of spaced side walls 12*a* and 12*b* which are connected together by a bottom wall 13 and a top wall 14. The actuator 11 encloses an electromagnet 15 between the side walls 12*a* and 12*b* and it supports three sets of movable main contacts 16 which are mounted to an integrally formed support 17 that extends upward from the top wall 14. A pair of coupling elements 18 are integrally formed on each side of the support 17 and extend laterally outward from the actuator axis.

The electromagnet 15 includes a magnetic circuit which is comprised of a stationary yoke 19 and a movable armature 20. The electromagnet 15 also includes a stationary coil structure 21 that surrounds the legs (not shown in the drawings) of the yoke 19. Electrical power is supplied to the coil 21 through a pair of input control terminals 28. One end of the stationary yoke 19 and coil structure 21 is received by the base 3 and the other end is received by a cover 22 which is fastened to the terminal post 4 and support posts 5 by a set of four screws 23. The cover 22 is formed of molded polyester and it includes a central opening 24 through which the coil structure 21 extends. A retainer element 25 formed of molded polyester is fastened to the front of the contact enclosure 6 by a pair of screws 26 and it serves to fully enclose the main contacts 7 and 16.

The actuator 11 slides along the actuator axis between a lower, or deenergized, position and an upper, or energized, position. During this stroke, the movable main contacts 16 are carried by the actuator 11 into contact with the stationary contacts 7, and during a portion of the stroke, bias springs (not shown in the drawings) are compressed to provide contact pressure between the movable and stationary contacts 16 and 7. During the initial portion of the stroke, therefore, the force generated by the electromagnet 15 need only overcome the deadweight of the armature structure and the frictional forces associated with the sliding motion of the actuator. However, after contact is made between the stationary contacts 7 and movable contacts 16, the force needed to drive the actuator rapidly rises as a result of the bias springs. For more detailed description of the actuator 11 and associated electromagnet 15, reference is made to the above-cited U.S. Pat. No. 3,134,869.

A standard three-pole contactor has been described and is applicable in the vast majority of situations. In some installations, however, it is desirable to connect other electrical devices to the contactor, and in such cases, the provision of additional power terminals, or poles, is necessitated. According to the present invention, a power pole module 35 is provided to expand the standard three-pole contactor. As will be described in more detail below, the power pole module 35 may be mounted on either side of the contactor enclosure 6 to provide a four-pole contactor, or in the alternative, two power pole modules 35 may be employed and mounted to each side of the contact enclosure 6 to provide a five-pole contactor.

Figure 2:
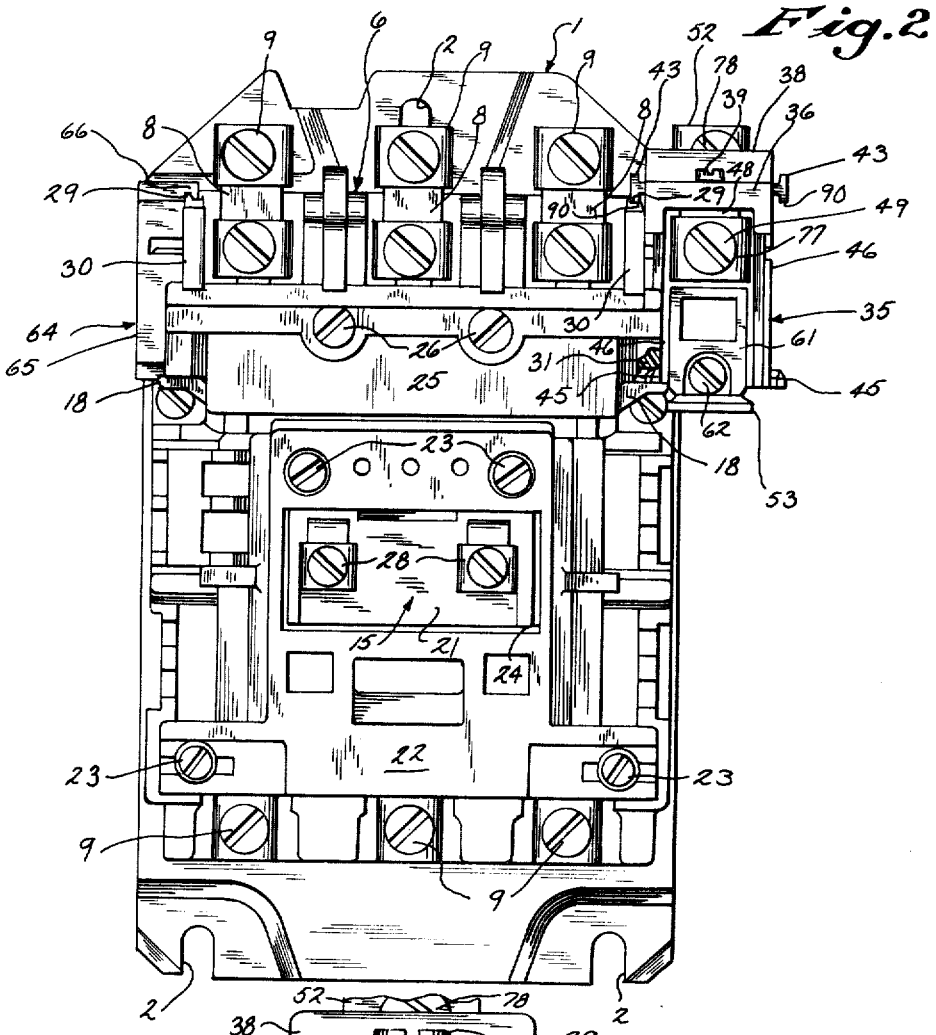
FIG. 2 is a front view of the contactor shown in FIG. 1.
Figure 6:
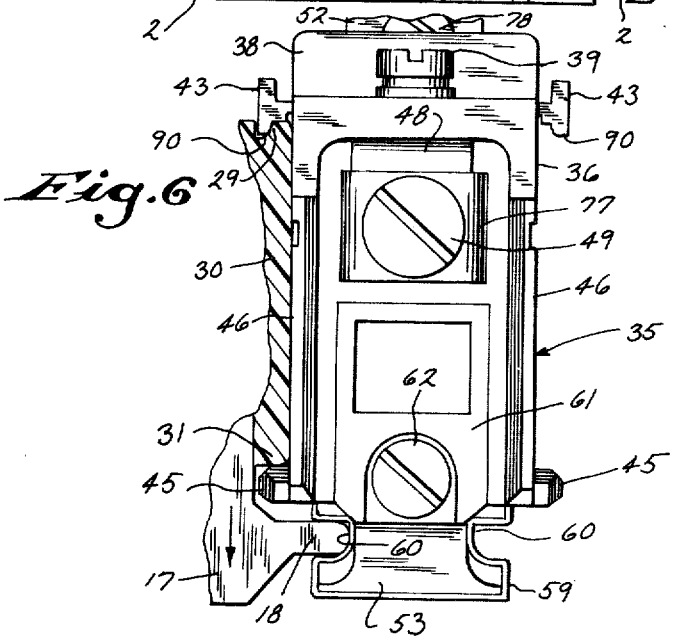
FIG. 6 is a front view of the power pole module and a partial view of the contactor to which it is attached.
Figure 3:
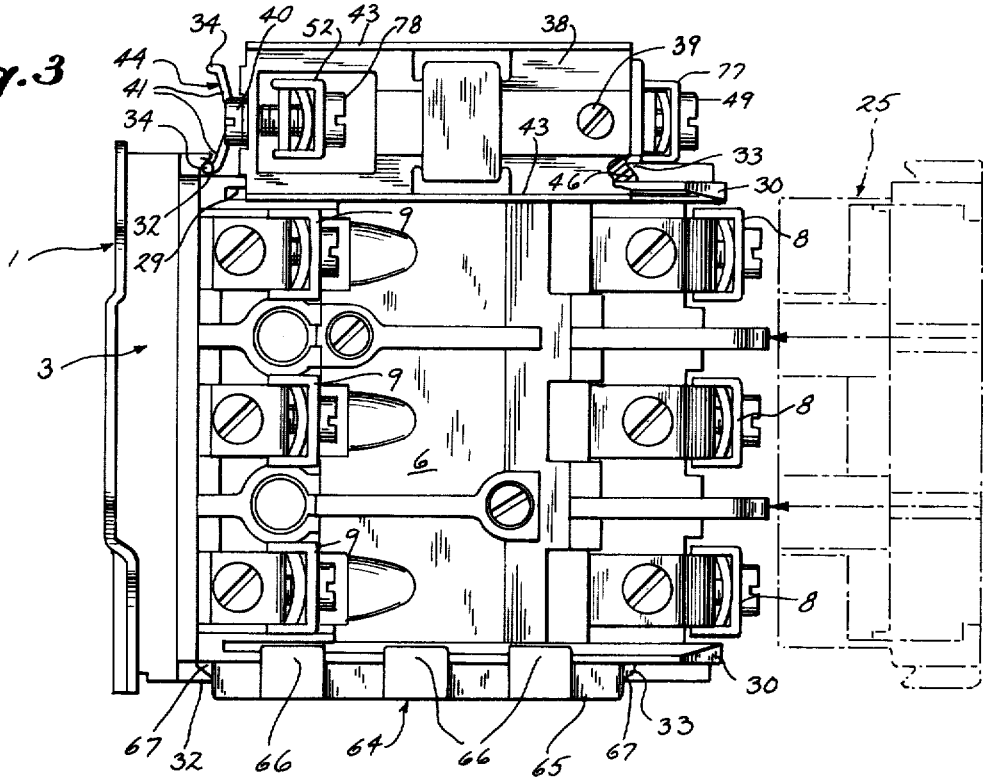
FIG. 3 is a top view of the contactor shown in FIG. 1.

As shown best in FIGS. 1–3 and 6, each side of the contact enclosure 6 is provided with a set of mounting elements for attaching a power pole module 35. The mounting elements on each side are identical and the description which follows applies to both sets. Referring specifically to FIGS. 2, 3, and 6, each set of mounting elements includes a channel 29 which is formed on the top surface of the contact enclosure 6 and extends along its side edge formed by the intersection of the top surface and a side wall 30. An opposing overhang 31 is formed along the lower boundary of the side wall 30 and serves in combination with the channel 29 to restrain the power pole module 35 against vertical motion. Referring particularly to FIG. 3, each set of mountings also includes a lip 32 which is integrally molded to the base 3 and is located substantially in the plane of the side wall 30 along its rear boundary. An opposing lip 33 is integrally formed on the retainer element 25 which is fastened to the front of the contact enclosure 6, and the lips 32 and 33 cooperate to restrain the power pole module 35 against horizontal motion.

Referring to FIGS. 1, 3 and 6, the power pole module 35 includes a two-piece housing 36 which is molded from a thermoset polyester and which is fastened together by a set of rivets 37. A resilient fastener 38 formed from a polyester resin, such as that sold commercially under the trademark, valox, is disposed on the top and back sides of the module 35 and fastened thereto by screws 39 and 40. The resilient fastener 38 includes a pair of integrally molded retainer rails 43 which are disposed along the entire length of the top surface of the module 35 and which extend laterally outward therefrom to overhang the sides of the module 35. As shown best in FIG. 6, each retainer rail 43 includes a downward extending flange portion 90 which is received by the channel 29 formed along the top edge of the contact enclosure 6 when the module 35 is fastened in place. The retainer rails 43 are flexible and provide a fastening force which pulls the module 35 upward.

As shown best in FIG. 3, the resilient fastener 38 also includes an integrally molded clip 44 which runs vertically along the back side of the module 35. The clip 44 includes two flexible wings 41 which extend laterally to each side of a center line drawn through the module 35 and which each terminate in rearward extending ridges 34. When the module 35 is mounted to the contactor, one of the ridges 34 is received by the lip 32 formed on the contactor base 3 and its associated wing is flexed to provide a fastening force which thrusts the module 35 forward.

Additional fastening elements which cooperate with the flexible retainer rails 43 and clip 44 are integrally formed on the module housing 36. As shown best in FIG. 6, a rib 45 extends laterally outward along the lower edge of each side of the module 35 and when the module 35 is mounted to the contactor, one of the ribs 45 extends beneath the overhang 31 and is drawn upward thereagainst by the upward bias force provided by the cooperating flexible retainer rail 43. As shown best in FIGS. 1 and 3, a second pair of ribs 46 are formed on the front surface of the module 35 along each of its side edges. When the module 35 is mounted to the contactor, the lip 33 formed on the retainer element 25 mates with one of the ribs 46 to lock the module 35 in place. The forward fastening force provided by the cooperating flexible clip 44 insures tight engagement of the lip 33 and rib 46 despite variations in the dimensions of the various interchangeable parts. The module 35 is thus restrained from moving in any direction when mounted to the contactor and it is easily installed and removed by loosening the screws 26 which hold the retainer element 25 in place.

As shown in the drawings, the module 35 may be mounted to the right hand side of the contactor to provide a four-pole structure. As a result of the symmetrical construction of the module 35, however, it can also be mounted to the left hand side of the contactor, or when a five-pole structure is required, a module 35 may be mounted on each side of the contact enclosure 6.

Figure 5:
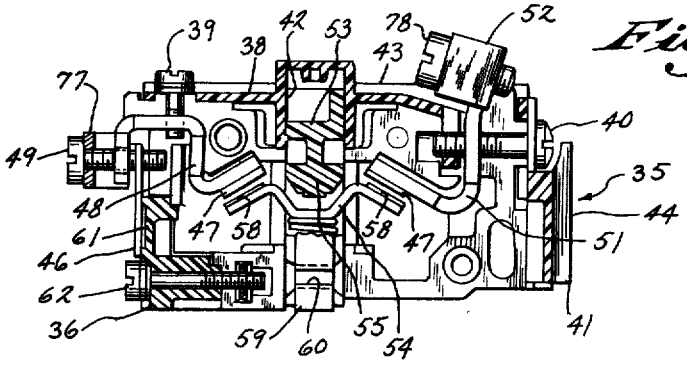
FIG. 5 is a view in cross section taken along a vertical plane through the power pole module.

Referring particularly to FIGS. 5 and 6, each power pole module 35 is self-contained and includes a set of stationary contacts 47 which are securely mounted within the housing 36 and a set of movable contacts 58 which are enclosed by the housing 36 and which are carried by a slidably mounted plunger 53. More specifically, the power pole module 35 includes a first stationary contact 47 which is welded to the end of front contact arm 48. The contact arm 48 is made of brass and is securely fastened to the housing 36 by screw 39. A screw 49 fastens a terminal lug 77 to the front of the contact arm 48. A second stationary contact 47 is similarly welded to the end of a back contact arm 51 which is rigidly mounted to the housing 36 by a screw 40. The back contact arm 51 extends upward through the top of the module 35 and a terminal lug 52 is fastened to its exposed end by a screw 78.

The plunger 53 is composed of thermoset material and is slidably retained within a rectangular cavity 42 which extends vertically through the center of the module 35 and between the spaced stationary contacts 47. The movable contacts 58 are welded to the ends of a bronze contact spanner 54 which extends transversely through an opening in the plunger 53 and which is held upward against an abutment 55 by a bias spring 56 when the contacts are open.

When the module 35 is mounted to the contactor, the plunger 53 is coupled to the contactor actuator 11 by the element 18 which extends laterally outward from the actuator 11, directly beneath the contact enclosure 6. A pair of recesses 60 are formed on opposite sides of the plunger 53 near its lower end and the coupling element 18 on the actuator 11 fits within one of these recesses 60 when the module 35 is fastened alongside the contact enclosure 6. A stainless steel liner 59 wraps around the lower end of the plunger 53 and covers the bearing surfaces of the recesses 60 to reduce wear.

The plunger 53 is operated by the contactor actuator 11 along a vertical axis which is parallel to the actuator axis. When deenergized, the contactor actuator 11 drops downward and the coupling element 18 pulls the plunger 53 downward. In this deenergized position the contacts within the module 35 are open and no current is conducted between the terminal lugs 77 and 52. When the contactor is energized, however, the actuator 11 and attached plunger 53 are driven upward to close the contacts within the module 35. Contact pressure is provided by the bias spring 56 which is compressed during the last portion of the actuator stroke.

It should be apparent to those skilled in the art that although normally open contacts are shown in the drawings, the invention is equally applicable to a module which contains normally closed contacts. In such case, the bias spring 56 is positioned above the plunger 53 in the retangular cavity 42 to assert a downward bias force on the plunger 53 which provides contact pressure when the plunger 53 is in its lowermost, or deenergized position.

Although a self-contained power pole module is provided by the housing 36 which completely encloses the elements of the module 35, a window is provided in the front wall of the housing 36 through which the contacts may be inspected. A cover 61 fits over the window and is held in place with a screw 62.

As indicated above, a single power pole module 35 may be mounted to either side of the contactor, or a pair of modules 35 can be mounted to provide a five-pole structure. In the latter case, each module 35 is disposed equidistant from and on opposite sides of the contactor actuator axis and the loading which each module 35 imposes on the actuator 11 is balanced by the symmetrical loading imposed by the other module 35. The actuator 11 thus rides smoothly within its guideway 10 and wear is kept to a minimum. To maintain this symmetrical loading when only one power pole module 35 is used, load balancer cartridge 64 is provided and is mounted to the contactor on the side opposite the single power pole module 35.

Figure 7:
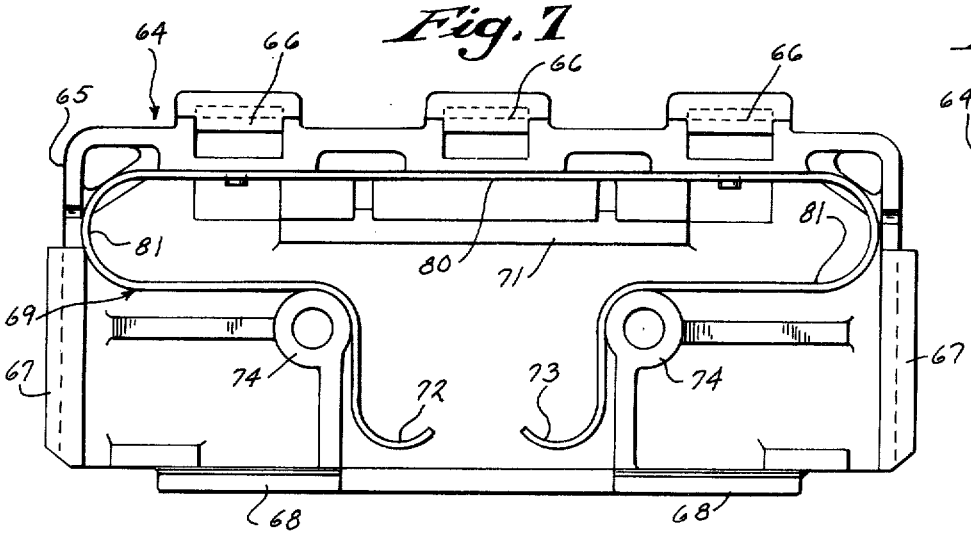
FIG. 7 is a side view of the load balancer shown in FIG. 1.
Figure 8:
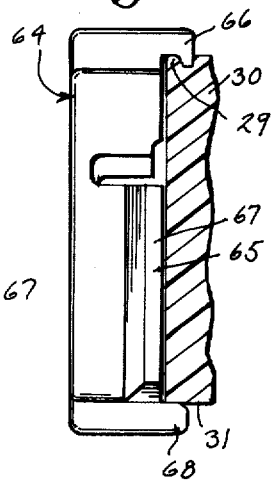
FIG. 8 is a front view of the load balancer shown in FIG. 1.
Figure 4:
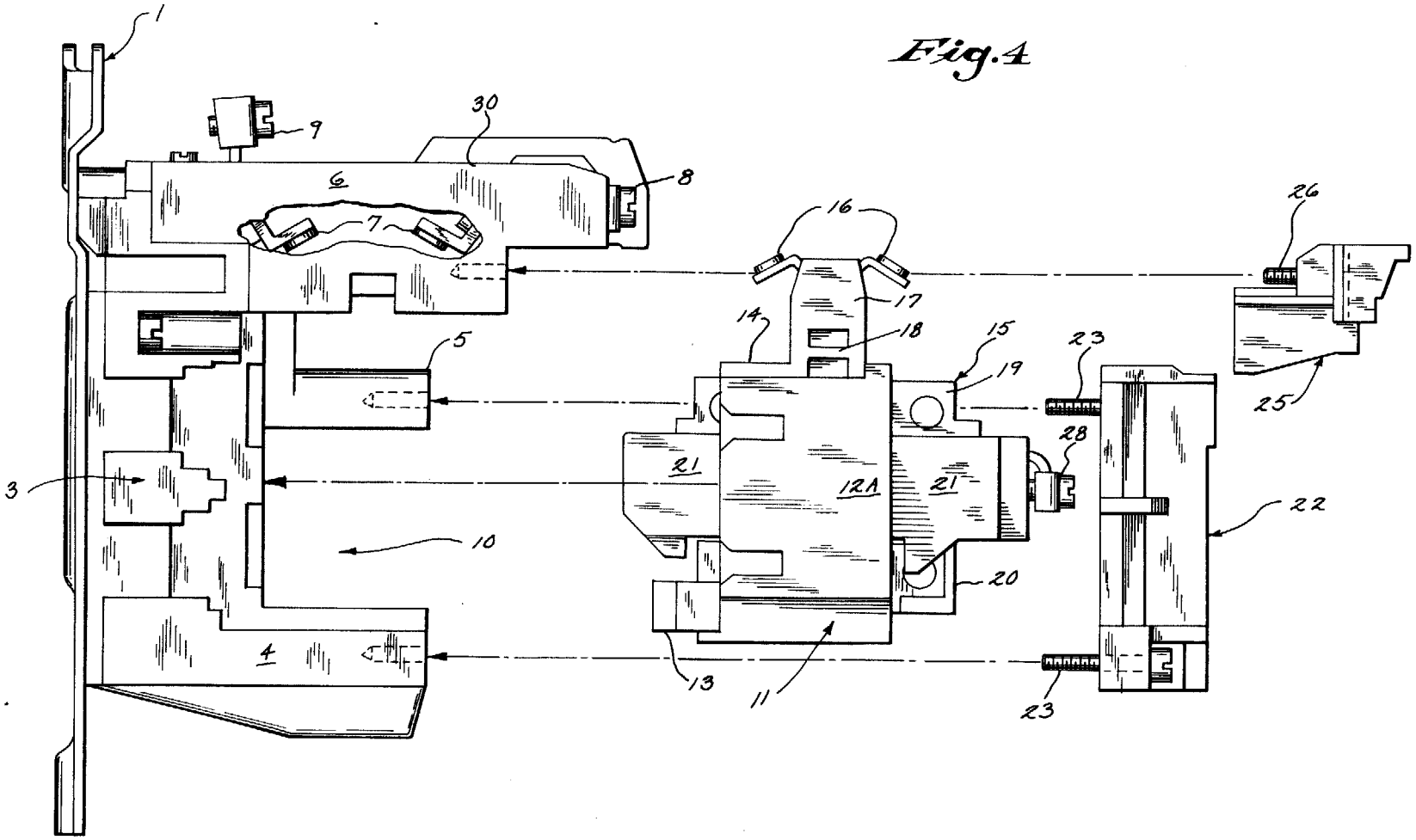
FIG. 4 is an exploded view with parts cut away of the contactor.

As seen best in FIGS. 7 and 8, the load balancer cartridge 64 has a generally rectangular housing 65 which is molded from a thermoplastic material and which is open on the side that faces the contactor when the cartridge 64 is mounted in place. The load balancer cartridge 64 is symmetrical about a vertical plane through its center so that it can be mounted to either side of the contactor.

Disposed around the perimeter of the cartridge 64 are fastening elements which mate with the mounting elements on the contactor. More specifically, three retainer members 66 are disposed along the top edge of the load balance 64. When the cartridge 64 is mounted to the contactor, the retainer members 66 wrap around the top edge of the contact enclosure 6 and extend downward into the channel 29. Disposed along the bottom edge of the cartridge 64 are a pair of integrally formed ribs 68 which extend beneath the overhang 31 on the contact enclosure 6 when the cartridge 64 is mounted in place. The retainer members 66 have some flexibility which serves to draw the ribs 68 upward into bearing engagement with the overhang 31 and to thus firmly restrain the load balancer 64 against vertical motion. Extending outward from each end of the load balancer 64 are ears 67 which are integrally molded to the housing 65. When mounted to the contactor, the ears 67 mate with the opposing lips 32 and 33 formed respectively on the contactor base 3 and retainer element 25. The load balancer 64 is thus restrained from horizontal motion. The load balancer 64 is, therefore, fastened to the contactor using the same mounting elements as the power pole module 35.

Contained within the housing 65 of the load balancer 64 is a loading spring 69 which is constructed from a strip of stainless steel. The loading spring 69 is disposed around the interior of the housing and terminates with a pair of curled ends 72 and 73 which are positioned within a channel 75 that extends downward through the lower wall of the housing 65. The loading spring 69 includes a lateral portion 80 which is retained against the upper wall of the housing 65 by an integrally formed bracing member 71, and a pair of loop portions 81 which are sprung against a pair of associated cylindrical stops 74. When the load balancer 64 is mounted on the right hand side of the contactor, the coupling element 18 on the contactor actuator 11 bears against the curled end 73 and works against the spring force generated by the right hand loop 81 to lift the loading spring 69 off the right hand cylindrical stop 74. Similarly, when mounted to the left hand side of the contactor, the coupling element 18 on that side bears against the curled end 72 and works against the spring force of the left hand loop 81 when the contactor is energized. The spring force generated by the load balancer 64 is chosen to match that of the bias spring in the power pole module 35 with which it is used.

We claim:

1. A switch, the combination comprising:

a base;

a contact enclosure connected to the base and including a pair of spaced side walls;

a set of stationary contacts disposed within said contact enclosure between said side walls;

an actuator mounted to said base to slide along an actuator axis;

movable contacts mounted to said actuator for movement along said actuator axis between an opened position and a closed position in which they engage said stationary contacts; and a power pole module mounted alongside said contact enclosure to one of said side walls, said power pole module including a set of stationary contacts substantially similar to the stationary contacts within said contact enclosure, a set of movable contacts substantially similar to the movable contacts mounted to said actuator, and means linking said movable contacts to said actuator for operating said movable contacts in response to the sliding motion of said actuator along said actuator axis.

2. The switch as recited in claim 1 in which said linking means including a plunger which is slidably mounted in said power pole module to move along an axis of motion parallel to the axis of actuator motion and which engages a coupling element formed along one side of said actuator.

3. The switch as recited in claim 2 in which the actuator is driven by an electromagnet in a vertical stroke and the contact enclosure is disposed above the electromagnet.

4. The switch as recited in claim 3 in which a pair of opposing mounting elements are disposed adjacent to each side wall and said power pole module includes fastening elements which mate with said opposing mounting elements to fasten said power pole module to said switch.

5. The switch as recited in claim 4 in which said fastening elements include a resilient fastener which provides a fastening force that maintains tight engagement with said pair of opposing mounting elements.

6. The switch as recited in claim 5 which includes a second pair of opposing mounting elements disposed substantially in the plane of each of said side walls and on opposite sides thereof, and said resilient fastener includes a clip formed from a flexible material which provides a fastening force that acts in a direction substantially perpendicular to the fastening force provided by said resilient fastener.

7. The switch as recited in claim 1 in which said power pole module includes a housing which surrounds the contacts and a removable cover is provided on the front of said housing to allow inspection of the contacts contained therein.

8. The switch as recited in claim 3 in which said actuator is symmetrical about a central vertical laxis and includes a second coupling element formed on its other side, and wherein a load balancer cartridge is mounted to said switch on the side wall opposite said power pole module and engages said second coupling element to impose a force thereon which is substantially equal to that imposed on the actuator by the power pole module.

9. The switch as recited in claim 8 in which the power poles module and load balancer are each symmetrical about a centerline to allow them to be mounted and used on either side of said switch.

10. In an of having a contact enclosure for housing a set o f stationary contacts, an actuator slidable along an axis between an unactuated and actuated position and supporting movable contacts engageable and disengageable with said stationary contacts, the improvement comprising:

a power pole module mounted alongside said contact enclosure to one side of said axis and including a slidably mounted plunger which carries a set of movable contacts and which couples with said actuator for motion along an axis parallel to said actuator axis; and a load balancer mounted alongside said contact enclosure to the opposite side of said actuator axis from said power pole module and coupled to said actuator for maintaining symmetrical loading thereon, said load balancer comprising:

a rectangular housing having downwardly extending retainer members formed along its top edge portion, outwardly extending ears formed along each of its ends and ribs formed along its bottom edge, said retainer members and ribs engageable with said contact enclosure for mounting said load balancer thereto, said housing further containing a loading spring having a pair of loop portions which are normally sprung against stops projecting from said housing, and a pair of curled ends, one of which engages said actuator upon the sliding movement thereof.

11. In a power pole module having a set of stationary and movable contacts, means for mounting and coupling said power pole module to an electrical switch, said means for mounting and coupling comprising:

a symmetrically constructed housing including a resilient fastener providing retainer rails and a clip along the top and rear portions, respectively, of said housing, forward protruding ribs formed at the front of said housing, and laterally projecting ribs constructed at the bottom of said housing; and a vertical plunger slidable within said housing for moving said movable contacts into open and closed relationship with said stationary contacts.

12. In an electrical switch having a base, a contact enclosure for housing a set of stationary contacts, an actuator slidably mounted to the base for motion along an actuator axis between an unactuated and actuated position and supporting movable contacts which engage said stationary contacts when the switch is actuated, the improvement comprising:

switch means mounted to one side of said base and coupled to said actuator for operation thereby when said actuator slides to its actuated position, said switch means imposing a load on one side of said actuator in a direction parallel to said actuator axis; and a load balancer consisting of a housing which encloses a loading spring, said load balancer being mounted to the other side of said base and coupled to said actuator for the sole purpose of imposing a load on the other side of said actuator in a direction parallel to the load imposed by said switch means.

* * * * *

UNITED STATES PATENT AND TRADEMARK OFFICE

CERTIFICATE OF CORRECTION

PATENT NO. : 3,962,658

DATED : June 8, 1976

INVENTOR(S) : Donald V. Zunft et al

It is certified that error appears in the above-identified patent and that said Letters Patent are hereby corrected as shown below:

| | |
|---|---|
| Column 2, line 22 | "maintain" should be -- maintains -- |
| Column 4, line 55 | "valox" should be -- Valox -- |
| Column 6, line 50 | insert -- a -- before "load" |
| Column 7, line 66 | "including" should be -- include -- |
| Column 8, line 31 | "laxis" should be -- axis -- |
| Column 8, line 40 (Claim 9) | "poles" should be -- pole -- |
| Column 8, line 43 (Claim 10) | after "an" delete "of" and insert -- electrical switch -- |
| Column 9, line 11 (Claim 11) | "forward" should be -- forwardly -- |

Signed and Sealed this

Seventh Day of September 1976

[SEAL]

*Attest:*

RUTH C. MASON
*Attesting Officer*

C. MARSHALL DANN
*Commissioner of Patents and Trademarks*